US006776649B2

(12) United States Patent
Pape et al.

(10) Patent No.: US 6,776,649 B2
(45) Date of Patent: Aug. 17, 2004

(54) CONTACT ASSEMBLY FOR A PLUG CONNECTOR, IN PARTICULAR FOR A PCB PLUG CONNECTOR

(75) Inventors: Günter Pape, Enger (DE); Andreas Kohler, Minden (DE)

(73) Assignee: Harting KGaA (DE)

( * ) Notice: Subject to any disclaimer, the term of this patent is extended or adjusted under 35 U.S.C. 154(b) by 165 days.

(21) Appl. No.: 10/062,026

(22) Filed: Jan. 31, 2002

(65) Prior Publication Data

US 2002/0106930 A1 Aug. 8, 2002

(30) Foreign Application Priority Data

Feb. 5, 2001 (DE) ..... 101 05 042

(51) Int. Cl.[7] ..... H01R 13/00

(52) U.S. Cl. ..... 439/485; 439/79; 439/608; 439/83; 439/206; 439/606

(58) Field of Search ..... 439/485, 79, 608, 439/610, 83, 206, 606, 604

(56) References Cited

U.S. PATENT DOCUMENTS 5,066,236 A * 11/1991 Broeksteeg ..... 439/79
5,353,191 A * 10/1994 Volz et al. ..... 361/690
5,795,191 A 8/1998 Preputnick et al. ..... 439/608
6,123,586 A * 9/2000 MacDougall ..... 439/701
6,171,149 B1 * 1/2001 Van Zanten ..... 439/608
6,174,202 B1 * 1/2001 Mitra ..... 439/608

FOREIGN PATENT DOCUMENTS

| | | | |
|---|---|---|---|
| EP | 0 622 871 | 3/1994 | ..... H01R/13/658 |
| EP | 0 422 785 B1 | 3/1995 | ..... H01R/23/68 |
| EP | 1 107 366 | 6/2001 | ..... H01R/12/16 |
| WO | WO 99/09616 | 2/1999 | ..... H01R/13/648 |

* cited by examiner

*Primary Examiner*—Truc Nguyen
(74) *Attorney, Agent, or Firm*—Hayes Soloway P.C.

(57) ABSTRACT

The invention relates to a contact carrier for a plug connector, in particular for a PCB plug connector. The contact carrier comprises a carrier body formed of a plastic material, and a plurality of contacts which are accommodated in the carrier body. Each of the contacts have two plug-in portions and one transition portion located between the two plug-in portions. The transition portions are exposed at least in part and the carrier body is provided with thermally conductive webs which are located between the transition portions and adjoin the latter.

8 Claims, 4 Drawing Sheets

CONTACT ASSEMBLY FOR A PLUG CONNECTOR, IN PARTICULAR FOR A PCB PLUG CONNECTOR

TECHNICAL FIELD

This invention relates to a contact assembly for a plug connector, in particular for a PCB plug connector.

BACKGROUND OF THE INVENTION

A generic contact assembly is known from European Patent 0 422 785. Such assembly comprises a carrier body formed of a plastic material and a plurality of contacts which are accommodated in the carrier body and each have two plug-in portions and one transition portion located between the two plug-in portions. The transition portions are exposed at least in part. The contacts are embedded within the carrier body by injection-molding. In the interior of the carrier body a recess is provided, through which the transition portions of the contacts freely extend. By appropriately choosing the exposed length of the transition portions, an impedance matching is to be achieved.

In some applications it may be desirable to mount a plug connector, equipped with the above-mentioned contact assemblies, on a printed circuit board by means of a reflow soldering method. In this method, a solder is applied onto the printed circuit board. Subsequently, the printed circuit board equipped with the plug connector is heated in an oven, so that the solder melts and the plug-in portions, which constitute contact pins and are plugged into the printed circuit board, are soldered to the printed circuit board.

In this method it is problematic that all contact pins must be heated as uniformly as possible, in order to obtain a consistently high quality of the soldered connection in all contact pins. It was found out that in the known contact assemblies a consistently good heating of the contacts is not ensured.

BRIEF SUMMARY OF THE INVENTION

It is the object of the invention to improve a contact assembly as mentioned above such that a rather uniform and quick heating of all contacts is ensured.

This is achieved in a contact assembly comprising a carrier body formed of a plastic material and a plurality of contacts which are accommodated in the carrier body and each have two plug-in portions and one transition portion located between the two plug-in portions. The transition portions are exposed at least in part and the carrier body is provided with thermally conductive webs which are located between the transition portions and adjoin the latter. The invention is based on the finding that the air between the transition portions, which is present in prior art contact assemblies, acts as insulator and prevents a uniform heating of the contact pins. The thermally conductive webs primarily serve to uniformly distribute the heat between the various contacts. Since via their transition portion the longer contacts of a contact assembly basically absorb more heat than the shorter contacts, there is obtained a temperature gradient between the contacts. This temperature gradient is leveled out by the thermally conductive webs. In addition, the thermally conductive webs offer a large heat-exchanging surface for the warm air in the oven, which heat-exchanging surface approximately is as large as the exposed surface of the transition portions. This provides for a faster heating of the contacts, which provides for short process times. A positive side effect of the thermally conductive webs finally is the fact that they stabilize the carrier body. To provide for a free circulation of the air between the contact assemblies during reflow soldering, said carrier body is made as thin as possible, therefore, an additional stabilization is welcome.

The principle underlying the invention can be expressed in other words as follows: The carrier body of the contact assembly is made very thin, namely with a thickness which corresponds to the thickness of the transition portions of the contacts. The result is that the contacts are exposed on the outsides of the carrier body. The thickness of the carrier body is larger than the distance of adjacent contact columns. The result is that between the individual carrier bodies a comparatively large distance exists, so that the warm air in the oven can easily circulate between the carrier bodies.

In accordance with a preferred embodiment of the invention it is provided that on an outside of the carrier body the thermally conductive webs terminate flush with the transition portions. This allows an unhindered circulation of the heated air between adjacent contact assemblies.

In accordance with the preferred embodiment of the invention it is furthermore provided that on an outside of the carrier body the thermally conductive webs are connected with each other by at least one reinforcing web which extends transverse to the transition portions. The reinforcing web stabilizes the thermally conductive webs, so that the same cannot bulge or even buckle under an axial load acting on the contact assembly, as it may occur for instance when mounting the contact assemblies.

Preferably, it is provided that the carrier body has a reinforcing edge which is thicker than the thermally conductive webs, and that the carrier body has a holding web which is likewise thicker than the thermally conductive webs, the reinforcing edge being separated from the holding web by a circulation passage. Both the reinforcing edge and the holding web increase the mechanical strength of the carrier body, and they are exactly arranged in those regions in which forces acting on the plug-in portions of the contacts must be introduced into the carrier body. The circulation passage serves to specifically heat that contact which has the shortest transition portion and therefore always is the slowest to heat up, namely the contact at the transition between holding web and reinforcing edge.

In accordance with an alternative embodiment of the invention it may be provided that the contacts in the region of the exit from the carrier body are surrounded by injection-molding for about 270°. It was found out that to firmly anchor the contacts in the carrier body it is not necessary to completely embed the contact by injection-molding, thus, material can be saved.

Advantageous aspects of the invention can be taken from the sub-claims.

DETAILED DESCRIPTION OF THE PREFERRED EMBODIMENTS

Figure 1:
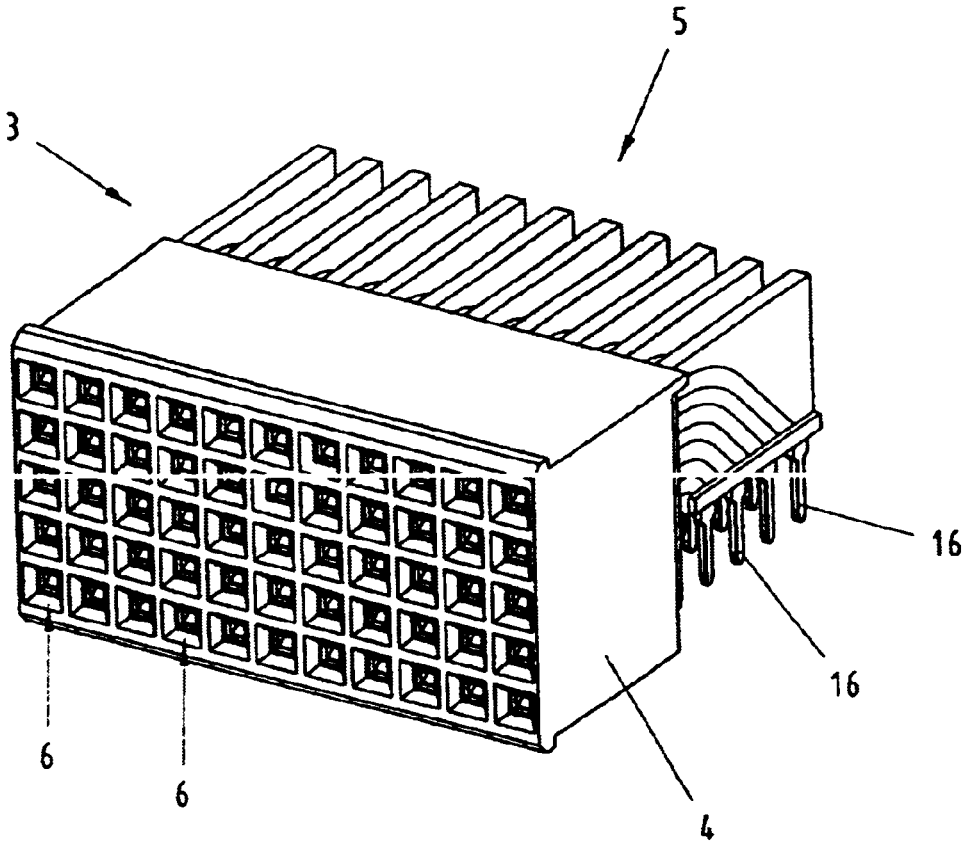
FIG. 1 shows a perspective, schematic view of a PCB plug connector which is equipped with contact assemblies according to the invention.

FIG. 1 shows a PCB plug connector 3 which has a housing 4 as well as a plurality of contact assemblies 5 inserted in the housing such that they are arranged with a small spacing parallel to each other and one beside the other. For each contact assembly, the housing has a column 6 of contact openings into which the contacts of a complementary plug connector can be plugged.

In the embodiment shown in the Figures, each contact assembly (see FIGS. 2 to 4) has five contacts 12 which each have two plug-in portions 14, 16 as well as one transition portion 18. The plug-in portions 14 constitute contact springs which are disposed in the housing 4 behind the contact openings. The plug-in portions 16 constitute contact pins which can be plugged into a printed circuit board (not shown in the Figures). Since the contact springs and the contact pins extend at an angle of 90° with respect to each other, this type of plug connector is also referred to as angled plug connector.

The contacts of a contact assembly are accommodated in a carrier body 20 formed of a plastic material and roughly has the shape of a flat cuboid. In the region of the transition from the contact springs 14 to the transition portions 18, the carrier body is provided with a thickened holding web 22. The same ensures a sufficient mechanical strength on the side of the contact assembly facing a complementary plug connector. Adjoining the holding web 22 a substantially flat middle portion 24 of the carrier body is disposed.

Figure 3:
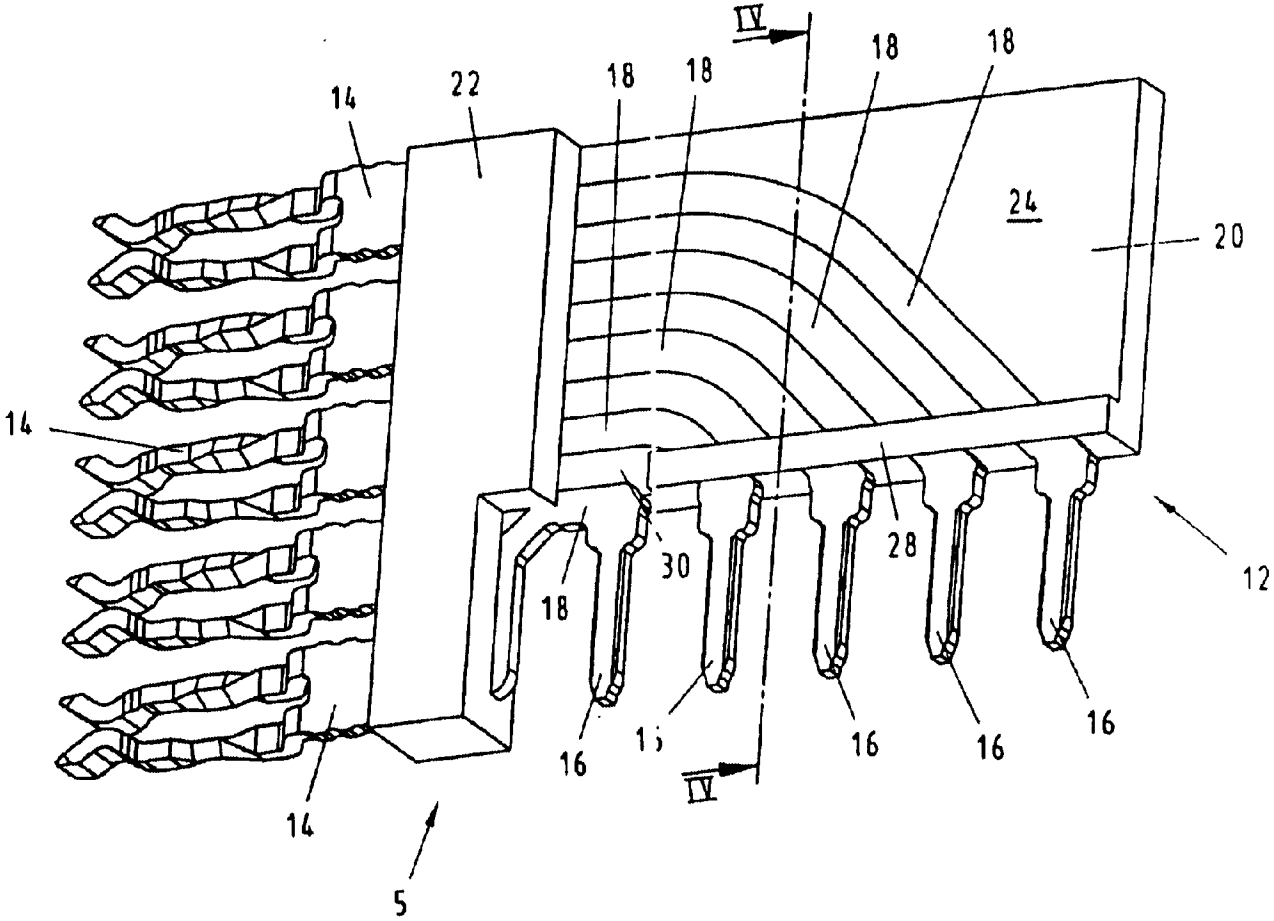
FIG. 3 shows another perspective view of the contact assembly of FIG. 2.
Figure 4:
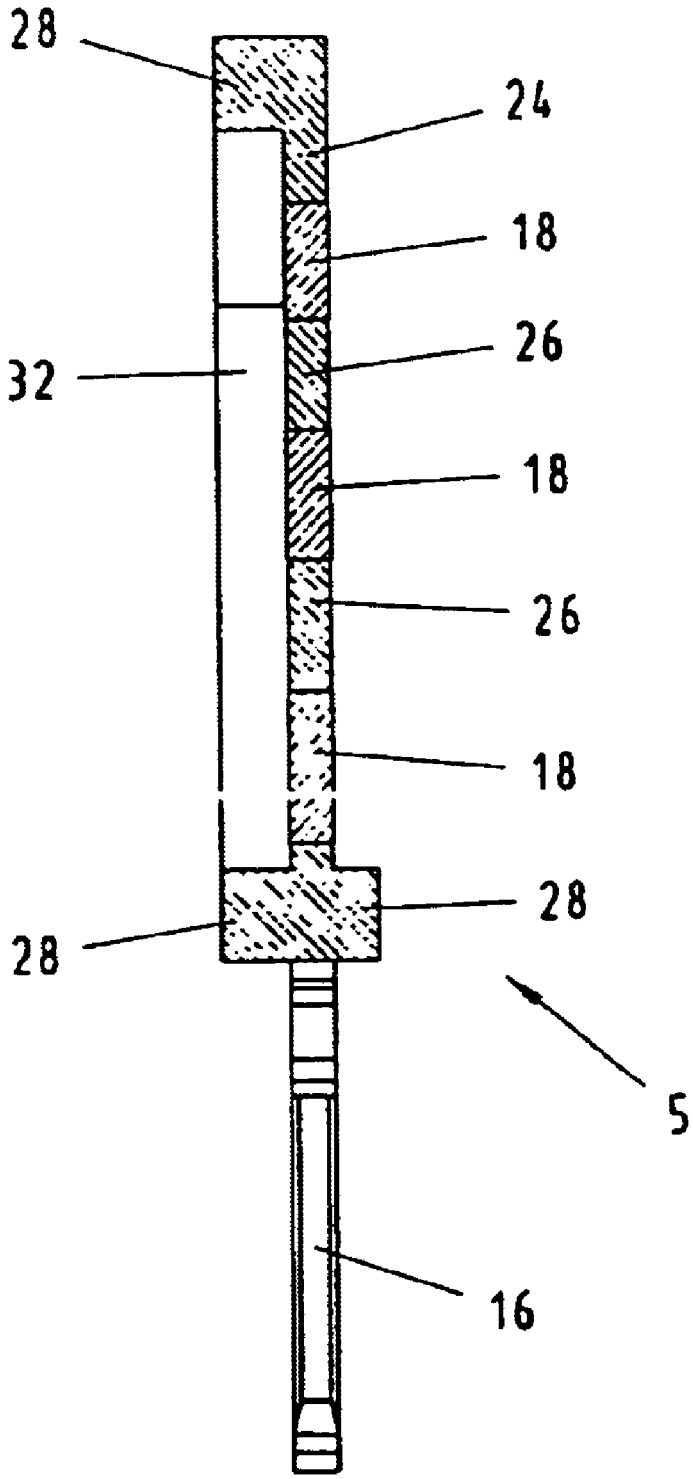
FIG. 4 shows a section along plane IV—IV of FIG. 3.

The middle portion 24 is provided with thermally conductive webs 26 which between each other have free spaces in which the transition portions of the contacts are disposed. The thermally conductive webs are as thick as the transition portions and adjoin the latter. As can be seen in FIG. 3, the thermally conductive webs terminate flush with the transition portions, so that this side of the middle portion 24 is flat with the exception of a reinforcing edge 28, which is formed adjacent the contact pins 16. The reinforcing edge 28 terminates at a distance from the holding web 22, so that a circulation passage 30 is formed, which provides for an improved circulation of air along the otherwise flat side of the middle portion 24. The circulation passage is disposed precisely in the region of the contact with the shortest transition portion, so that this contact is heated specifically.

Figure 2:
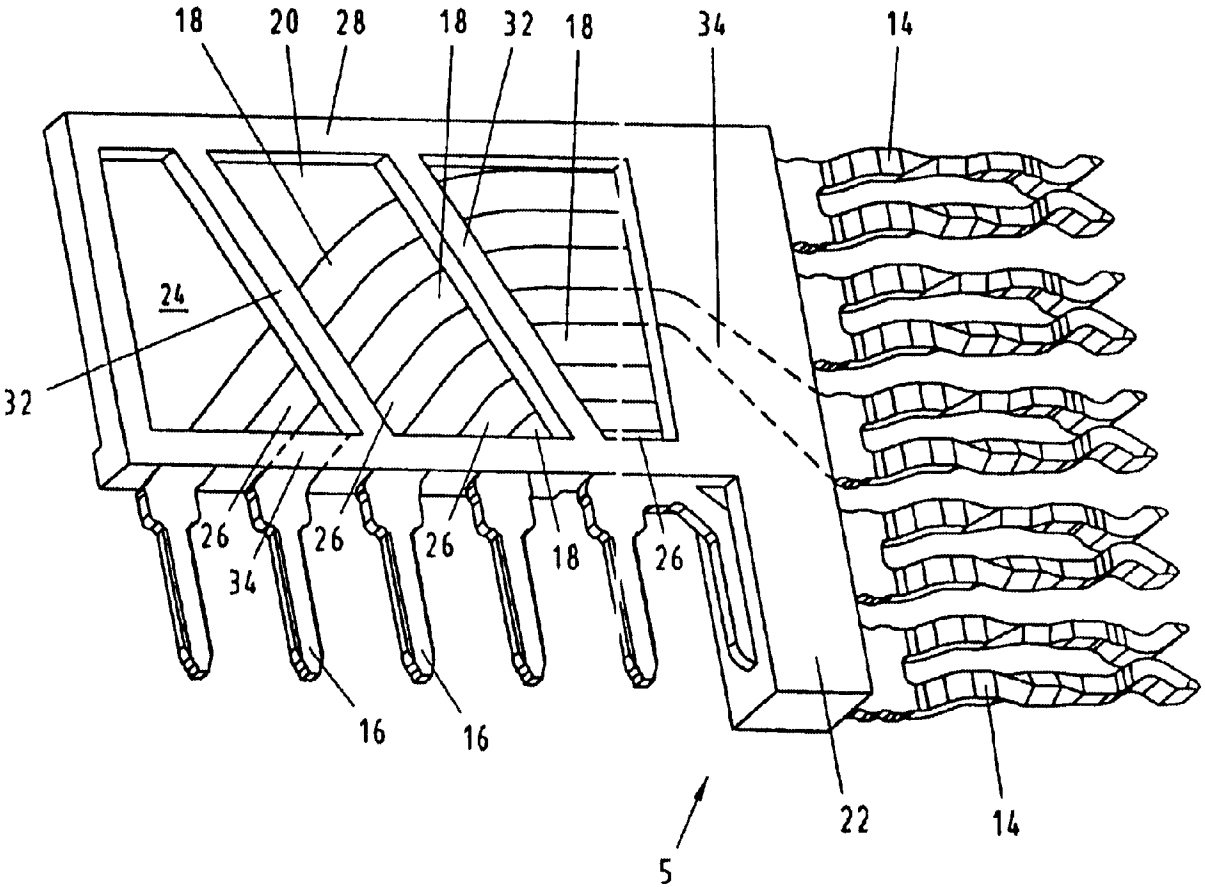
FIG. 2 shows a perspective view of a contact assembly according to the invention.

On the side of the middle portion 24 to be seen in FIG. 2, the reinforcing edge 28 is formed continuously. Between the upper edge and the lower edge in this Figure two reinforcing webs 32 are formed, which are integrally connected with the thermally conductive webs 26. The reinforcing webs 28 serve as contact surface for the transition portions 18 of the contacts.

In FIG. 2, an alternative embodiment is indicated in broken lines, in which grooves 34 are spared in the reinforcing edge 28 and in the holding web 22 in the region of the exit of the contacts from the carrier body; thus, the contacts are surrounded by injection-molding in this region only for about 270°. This design leads to a saving of material and a further improved circulation of air.

Apart from the good circulation of air along the outsides of the contact assembly, the above-described design has another advantage: Since the middle portion is made very thin, namely with the same thickness as the transition portions of the contacts, the volume of plastic material, which must be heated during soldering together with the contacts, is minimized. This ensures a rather uniform heating within a rather short period.

What is claimed is:

1. A contact carrier for a plug connector, in particular for a PCB plug connector, said contact carrier comprising a carrier body fanned of a plastic material, and a plurality of contacts which are accommodated in said carrier body, each of said contacts having two plug-in portions and one transition portion located between said two plug-in portions, said carrier body being provided with thermally conductive webs which are located between said transition portions and adjoin the latter; wherein said transition portions are exposed at least in part when said contact carrier is completely mounted at a plug connector.

2. The contact carrier as claimed in claim 1, wherein on an outside of said carrier body said thermally conductive webs terminate flush with said transition portions.

3. The contact carrier as claimed in claim 1, wherein on an outside of said carrier body said thermally conductive webs are connected with each other by at least one reinforcing web which extends transverse to said transition portions.

4. The contact carrier as claimed in claim 1, wherein said carrier body has a reinforcing edge which is thicker than said thermally conductive webs.

5. The contact carrier as claimed in claim 4, wherein said carrier body has a holding web which is thicker than said thermally conductive webs, said reinforcing edge being separated from said holding web by a circulation passage.

6. The contact carrier as claimed in claim 1, wherein said carrier body surrounds three faces of said contacts or approximately 270° of said contact.

7. The contact carrier as claimed in claim 1, wherein said thermally conductive webs are as thick as said transition portions and terminate flush with said transition portions.

8. A plug connector having a plurality of contact carriers, each of said contact carriers comprising a carrier body formed of a plastic material, and a plurality of contacts which are accommodated in said carrier body, each of said contacts having two plug-in portions and one transition portion located between said two plug-in portions, said carrier body being provided with thermally conductive webs which are located between said transition portions and adjoin the latter, wherein said transition portions are exposed at least in part when said contact carrier is completely mounted, and wherein a distance exists between adjacent said contact carriers, thereby permitting air circulation between said carrier bodies.

* * * * *

UNITED STATES PATENT AND TRADEMARK OFFICE

CERTIFICATE OF CORRECTION

PATENT NO. : 6,776,649 B2
DATED : August 17, 2004
INVENTOR(S) : Pape et al.

It is certified that error appears in the above-identified patent and that said Letters Patent is hereby corrected as shown below:

Column 4,
Line 12, "fanned" should be -- formed --.

Signed and Sealed this

Eighth Day of February, 2005

JON W. DUDAS
*Director of the United States Patent and Trademark Office*